US005961340A

United States Patent [19]

Littlejohn et al.

[11] Patent Number: 5,961,340

[45] Date of Patent: Oct. 5, 1999

[54] WIRE TRIMMER

[75] Inventors: Kenneth C. Littlejohn, Northlake; Jane X. Lee, Bloomingdale, both of Ill.

[73] Assignee: Reltec Corporation, Mayfield Heights, Ohio

[21] Appl. No.: 09/041,182

[22] Filed: Mar. 12, 1998

Related U.S. Application Data

[60] Provisional application No. 60/039,082, Mar. 14, 1997.

[51] Int. Cl.[6] ..... H01R 4/24

[52] U.S. Cl. ..... 439/392; 439/404

[58] Field of Search ..... 439/404, 392, 439/395

[56] References Cited

U.S. PATENT DOCUMENTS 3,202,957 8/1965 Leach .
4,326,767 4/1982 Silbernagel et al. .
4,444,448 4/1984 Silbernagel et al. .
4,834,668 5/1989 Markwardt .
4,875,875 10/1989 Archer et al. .
5,178,558 1/1993 Knox et al. .
5,281,163 1/1994 Knox et al. .

*Primary Examiner*—Paula Bradley
*Assistant Examiner*—Antoine Ngandjui
*Attorney, Agent, or Firm*—Trexler, Bushnell, Giangiorgi & Blackstone, Ltd.

[57] ABSTRACT

A cutting element configured for use in an electrical connector device for cutting two or more wires received by the electrical connector device. The cutting element includes a member having a leading edge, and the leading edge is shaped for nonsimultaneously cutting multiple wires in a single cutting motion. By cutting the wires nonsimultaneously, less force is needed to effect the cutting operation.

24 Claims, 5 Drawing Sheets

WIRE TRIMMER

RELATED APPLICATION

This application claims the benefit of U.S. Provisional Application No. 60/039,082, filed Mar. 14, 1997.

INVENTORS

Kenneth C. Littlejohn 29 North Edward Ave. Northlake, Ill. 60164 A citizen of the United States of America Jane X. Lee 222 Lehigh Lane Bloomingdale, Ill. 60108 A citizen of the People's Republic of China

BACKGROUND

A variety of terminal blocks are available which allow for interconnection between communication lines. In this regard, such terminal blocks are used to connect outside lines or feeder wires with inside lines or distribution wires. Some prior art terminal blocks provided interconnection by wrapping the wire, with the insulation removed, around a binding post. Cross connection to a distribution wire was made to a similar binding post coupled to the feeder wire binding post. These prior art devices functioned well but were labor intensive such that they required stripping of each of the wires and mechanical connection to the binding posts.

The prior art evolved to provide interconnection terminal blocks which include insulation displacement connectors (IDC) to simultaneously conductively terminate the wire while stripping the insulation away from the conductive wire. An inner cavity of the terminal block housing is often filled with a protective, non-conductive grease or gel which provides environmental protection for the wire engaged in the IDC clip.

Problems often arose because the end of the wire extending from the terminal block was not covered in the protective material. Therefore, the end of the wire was not protected from corrosion or other detrimental environmental effects. One way of attempting to solve this problem was to require the trades person, who installs lines using the terminal block, to position the lines with the ends inside the terminal block. This solution was somewhat unfeasible as it required extra effort on the part of the trades person and oftentimes resulted in lines which were improperly positioned within the terminal block.

Another solution to the problem relating to extending wire ends was to provide a cutoff device which cuts off the ends of the wires. While some cut off devices have served their purpose, others do not sufficiently cut the lines and tend to merely deform the line in a corresponding trough. As a result, the trades person must to clip off the line so as to not have exposed wire ends which are subjected to the detrimental environmental effects. Another disadvantage is that many of the cutoff devices require a great amount of force to operate. This is especially true in situations where more than one wire is to be cut by the cutoff device.

OBJECTS AND SUMMARY

A general object of the present invention may be to provide a cutting element configured for use in an electrical connector device, such as a terminal block, for cutting two or more wires received by the electrical connector device.

Another object of the present invention may be to provide a cutting element configured for use in an electrical connector device, such as a terminal block, for cutting two or more wires received by the electrical connector device in a single motion.

Still another object of the present invention may be to provide a cutting, element configured for use in an electrical connector device, such as a terminal block, for nonsimultaneously cutting multiple wires in a single cutting motion in order to reduce the amount of force needed to effect the cutting operation.

Briefly, and in accordance with the foregoing, the present invention envisions a cutting element configured for use in an electrical connector device for cutting two or more wires received by the electrical connector device. The cutting element includes a member having a leading edge, and the leading edge is shaped for nonsimultaneously cutting multiple wires in a single cutting motion.

BRIEF DESCRIPTION OF THE DRAWINGS

The organization and manner of the structure and function of the invention, together with the further objects and advantages thereof, may be understood by reference to the following description taken in connection with accompanying drawings, wherein like reference numerals identify like elements and in which.

Figure 1:
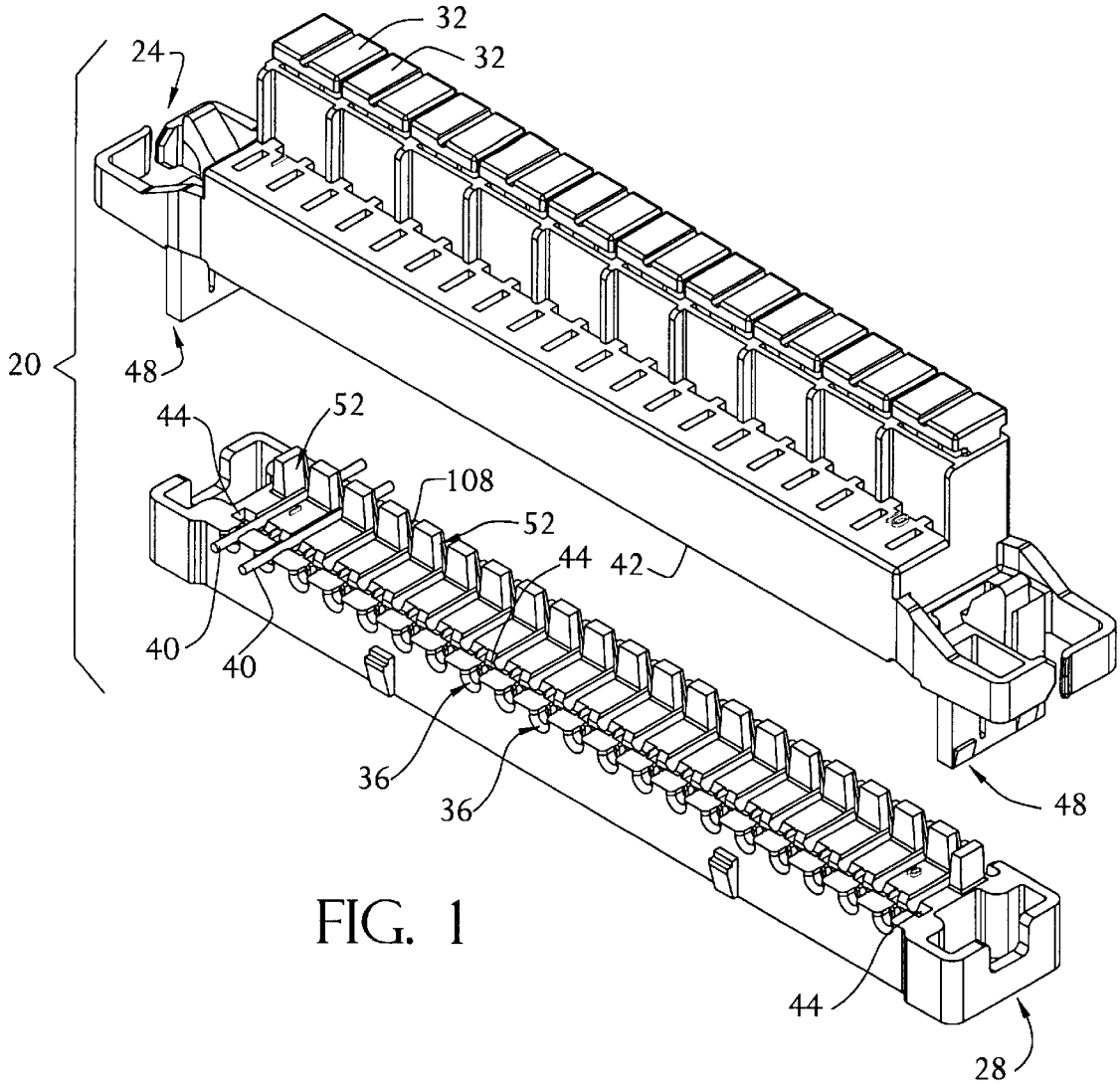
FIG. 1 is an exploded perspective view of a terminal block assembly, showing an upper portion and a platform portion thereof, and showing two representative feeder wires positioned in the platform portion.
Figure 2:
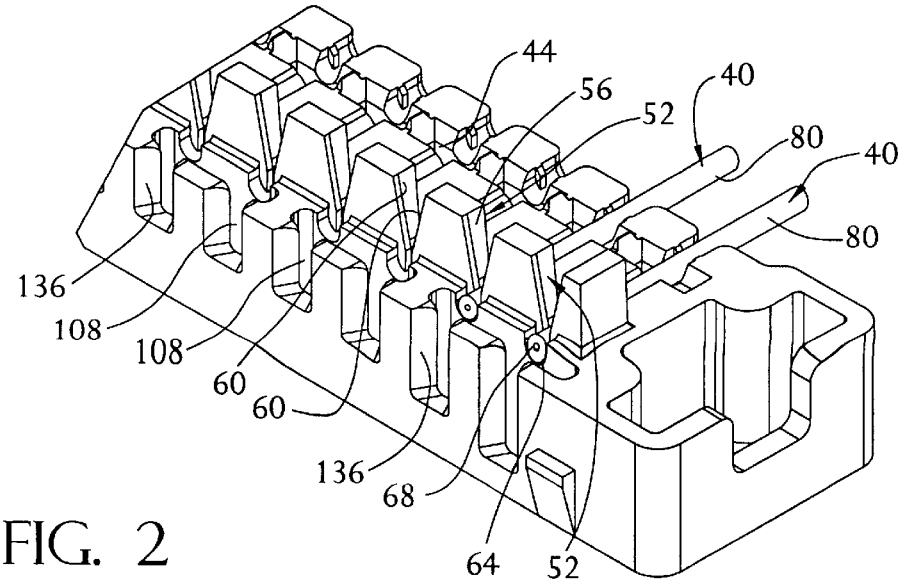
FIG. 2 is an enlarged, partial fragmentary, perspective view, taken from the opposite side as that of FIG. 1, of the platform portion of the terminal block shown in FIG. 1, showing the retention of the feeder wires therein.
Figure 10A:
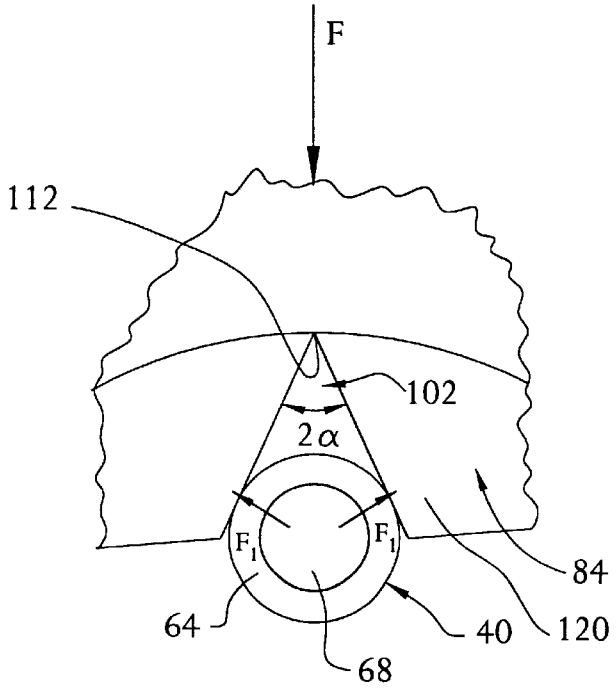
Figure 10B:
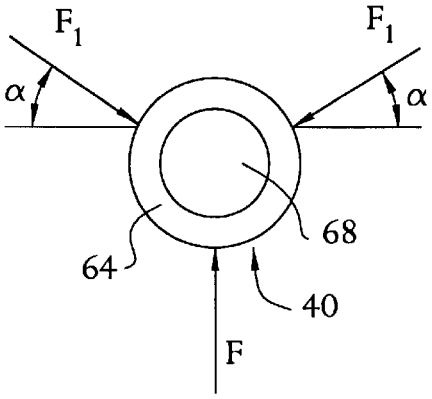

FIG. 10*a* is a free-bodied diagram of one of the cutting structures shown in FIGS. 3, 4, 5, 6, 7 and 8 cutting a wire, such as one of the feeder wires shown in FIGS. 1 and 2, depicting the forces acting on the cutting structure; and FIG. 10*b* is a free-bodied diagram of one of the cutting structures shown in FIGS. 3, 4, 5, 6, 7 and 8 cutting a wire, such as one of the feeder wires shown in FIGS. 1 and 2, depicting the forces acting on the wire.

DESCRIPTION

While the present invention may be susceptible to embodiment in different forms, there is shown in the drawings and herein will be described in detail, an embodiment with the understanding that the present description is to be considered an exemplification of the principles of the invention and is not intended to limit the invention to that is illustrated and described herein.

Shown in FIG. 1 is a terminal block 20 for terminating distribution wires therein. The terminal block 20 includes an upper portion 24 and a platform portion 28 or lower portion. The upper portion 24 includes a plurality of interconnect assemblies 32 which may have a conventional construction including wire connecting actuators for receiving and engaging distribution wires therein. The platform portion 28 of the terminal block 20 includes a plurality of wire receiving channels 36 in which outside lines or feeder wires 40 are laid for termination within the terminal block 20. FIGS. 1 and 2 show two representative feeder wires 40, each laying in a wire receiving channel 36 in the platform portion 28. The feeder wires 40 are positioned for termination with IDC connectors carried on an underside 42 of the upper portion 24 of the terminal block 20. The IDC connectors mate with individual apertures 44, each corresponding to a respective wire receiving channel 36, for termination with corresponding feeder wires laying in the wire receiving channels 36.

The wires 40 positioned on the platform portion 28 are terminated by engaging the upper portion 24 of the terminal block 20 with the platform portion 28 of the terminal block 20. The upper portion 24 is retained in engagement with the platform portion 28 by locking structures 48 provided on the upper portion 24. Of course, other types of retaining structure may be provided than that which is depicted in the Figures.

Each wire 40 is positioned in a corresponding channel 36 and is retained therein by a strain relief structure 52. As shown in FIG. 2, each strain relief structure 52 includes a V-shaped mouth 56 which can receive a variety of wire diameters and which includes engaging edges 60. The engaging edges 60 impinge on or project into the insulating outer covering 64 of the wire 40. The engaging edges 60 do not necessarily cut the insulating outer covering 64 of the wire 40. However, preferably when the engaging edges 60 engage the wire 40, the engaging edges 60 do not contact the central conductor 68 of the wire 40.

With the wires 40 retained in the platform portion 28 of the terminal block 20 as shown in FIGS. 1 and 2, the upper portion 24 of the terminal block 20 is brought downwardly to force the wire 40 into the IDC which is retained on the underside 42 of the upper portion 24. Projecting portions of the IDC extend into the aperture 44 associated with each wire receiving channel 36. The strain relief structures 52 prevent the wire from being i pulled out of position relative to the IDC and aperture 44. As such, the terminal block 20 of this construction provides an efficient and reliable conductive connection between the wires 40 and the interconnect assemblies 32. It should be clear to one having ordinary skill in the art that conductive connections are provided in the upper portion 24 of the terminal block 20 to connect the wires 40 with the interconnect assemblies 32. This allows a trades person to selectively connect distribution wires inserted into the interconnect assemblies 32 on the upper portion 24 of the terminal block 20.

Figure 3:
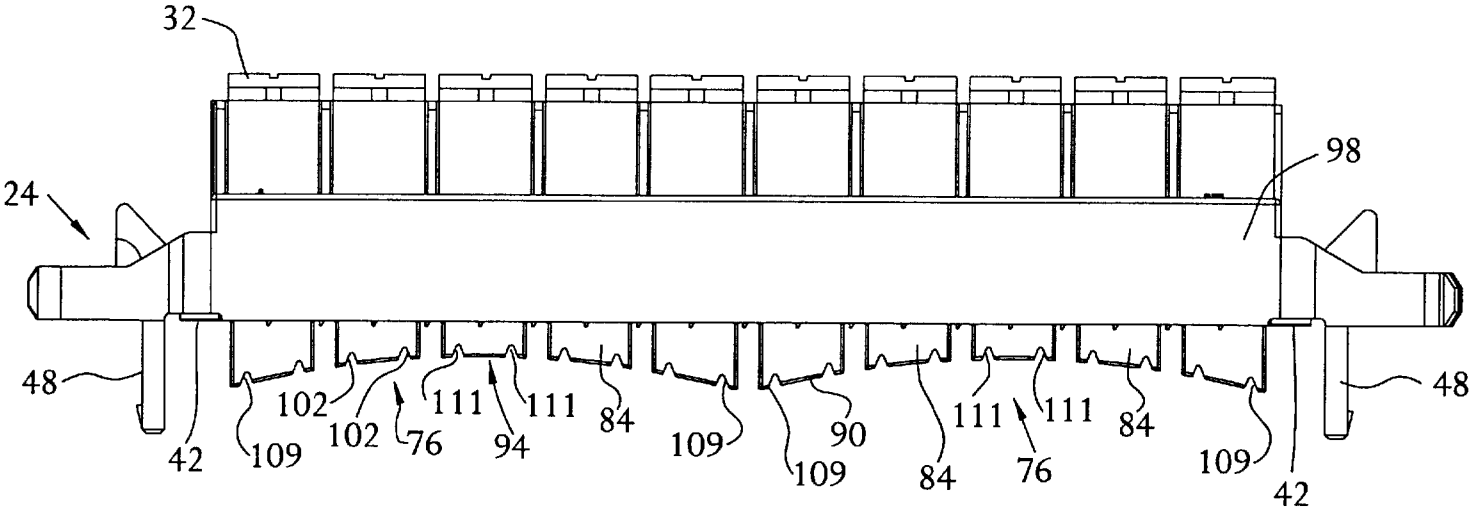
FIG. 3 is a side elevational view of the upper portion of the terminal block shown in FIG. 1, showing a plurality of cutting structures positioned on an underside of the upper portion for trimming the feeder wires retained in the platform portion of the terminal block as shown in FIGS. 1 and 2.
Figure 4:
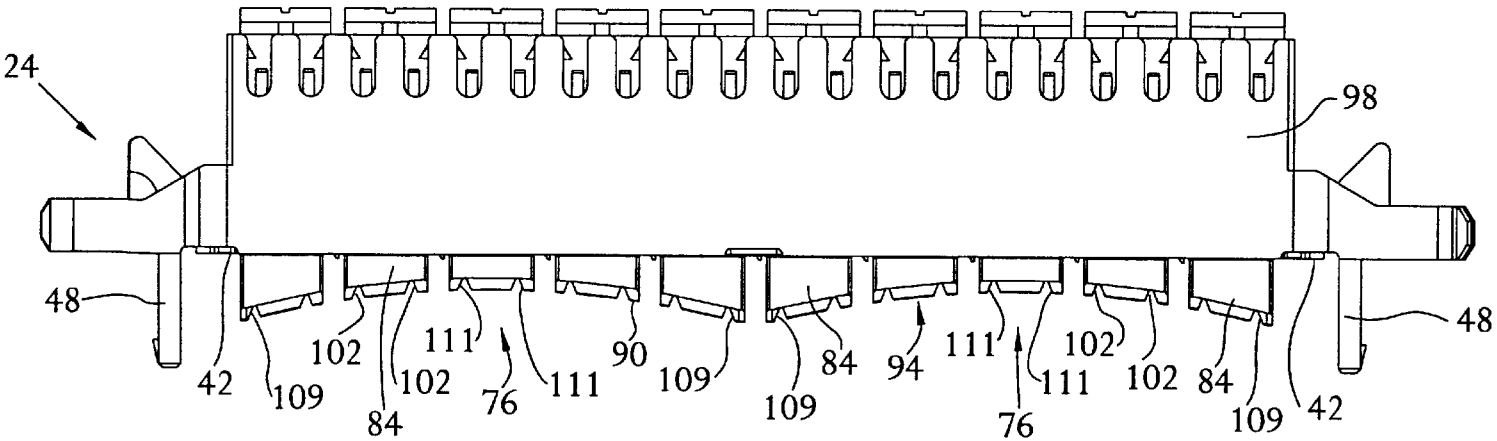
FIG. 4 is a side elevational view of the upper portion of the terminal block shown in FIG. 1, showing the opposite side from that which is shown in FIG. 3, and showing the plurality of cutting structures positioned on the underside of the upper portion of the terminal block for trimming the feeder wires retained in the platform portion of the terminal block as shown in FIGS. 1 and 2.
Figure 5:
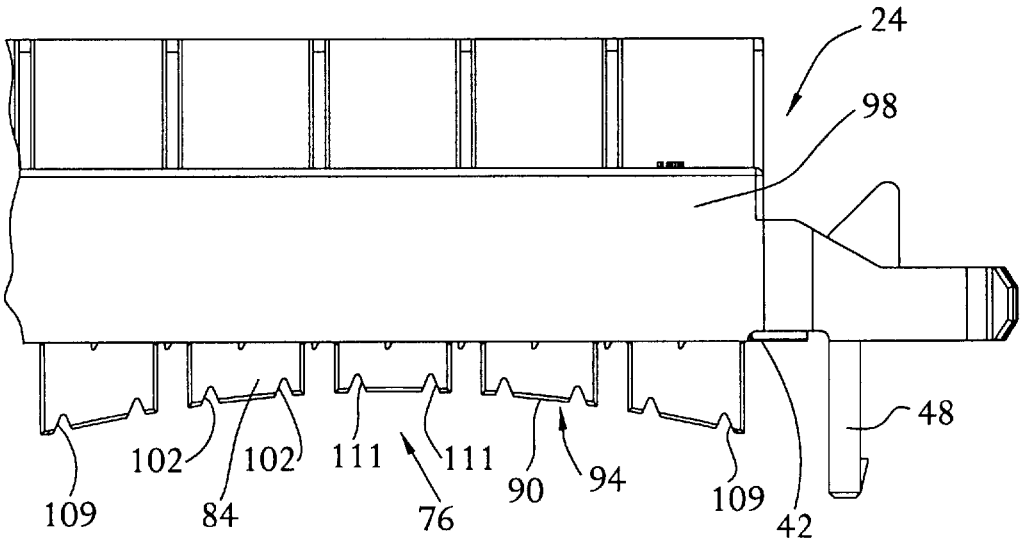
FIG. 5 is an enlarged view of a segment of the upper portion of the terminal block which is shown in FIG. 1, showing a group of the cutting structures shown in FIGS. 3 and 4, the group being collectively referred to as a cutting apparatus.
Figure 6:
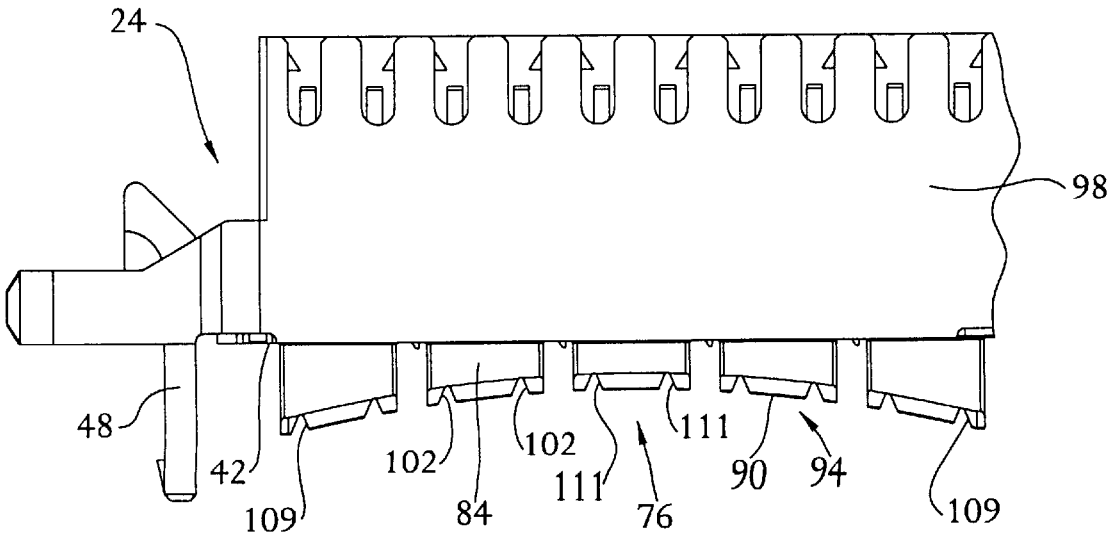
FIG. 6 is an enlarged view of the opposite side of the segment of the upper portion of the terminal block shown in FIG. 5.

Once the wires 40 are positioned in the platform portion 28 as shown in FIGS. 1 and 2, a cutting assembly or apparatus 76 as shown in FIGS. 3, 4, 5 and 6 (two assemblies are shown in FIGS. 3 and 4, and one of the two assemblies are shown in FIGS. 5 and 6) extending from the underside 42 of the upper portion 24 can be driven against a free end 80 of the wires 40 retained in the channels 36.

The cutting assembly 76 includes a plurality of blades or cutting structures 84. While the upper portion 24 of the terminal block 20 is shown in FIGS. 3 and 4 as having two cutting assemblies 76 each consisting of five cutting structures 84, a different number of cutting assemblies and/or cutting structures per cutting assembly may be provided.

A leading edge 90 of each cutting structure 84 is arranged to generally define a non-linear edge 94. As can be seen in the enlarged view of FIGS. 5 and 6, the non-linear edge 94 is defined as an arcuate edge which curves inwardly towards a central body portion 98 of the upper portion 24 of the terminal block 20.

Figure 9A:
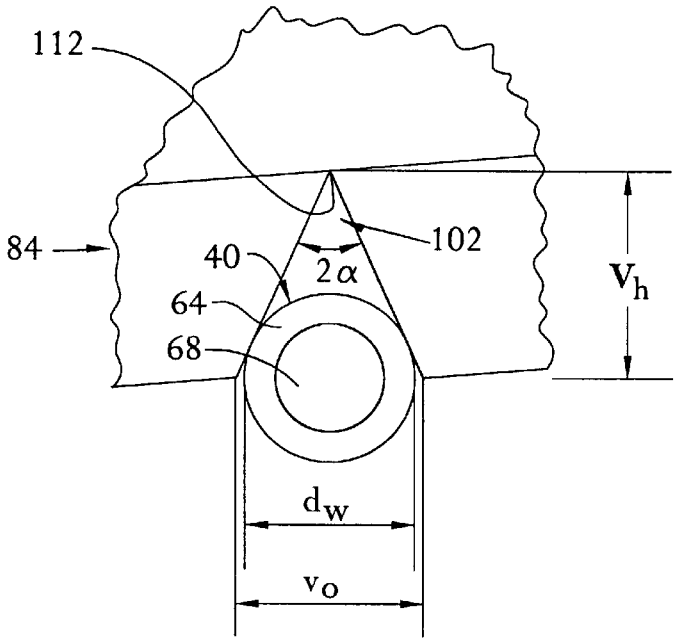
FIG. 9*a* is a front, diagrammatic view illustrating the process of one of the cutting structures shown in FIGS. 3, 4, 5, 6, 7 and 8 cutting a wire, such as one of the feeder wires shown in FIGS. 1 and 2.

As shown, a pair of notches 102, 102 are preferably provided on each cutting structure 84. Walls defining each of the notches 102 are angled with respect to each other and receive and engage a wire positioned in the respective wire receiving channel 36 in the platform portion 28 of the terminal block 20 as shown in FIGS. 9*a*, 9*b*, 10*a* and 10*b*. The notches 102, 102 initially engage the free end 80 of the wire 40, as shown in FIGS. 9*a* and 10*a*, as the upper portion 24 of the terminal block 20 is brought into engagement with the platform portion 28. While a pair of notches 102 are shown on each cutting structure 84, a different number of notches may be provided on each cutting structure 84 to effect essentially the same purpose as will be described. Regardless, each cutting structure 84 preferably telescopically engages and fits into a receptacle 108, as depicted in FIGS. 1 and 2, provided in a corresponding area on the platform portion 28 of the terminal block 20.

The non-linear edge 94 of each cutting structure 84 is used to facilitate step-by-step engagement and cutting or shearing of the wires 40. In this regard, the wires are sheared starting with the outermost notches 109 of each cutting assembly 76 and then proceeding inwardly from each end of each cutting assembly 76 to innermost notches 111 of the cutting assembly 76. Therefore, only a limited number of wires are sheared at any given moment during the process of engaging the upper portion 24 of the terminal block 20 with the platform portion 28. As a result, the forces which is needed to engage the upper and platform portions 24, 28, and shear the wires using the cutting structures 84 is reduced.

In the specific embodiment terminal block 20 shown in FIG. 1, and in which cutting assemblies 76 thereof are shown in FIGS. 3, 4, 5 and 6, the non-linear edge 94 of each cutting structure 84 is defined by a parabolic curve of the equation $Y=-0.1018489X^2+0.1771653$. The curve defined by this equation is a preferred embodiment and is designed to control the number of wires entering the cutting process at each time frame of the engagement of the upper portion and platform portion 24, 28 of the terminal block 20. In the present embodiment, there are four wires entering the cutting process during each time frame, two wires for each cutting assembly 76. The overall span of the cutting assembly 76 and non-linear edge 94 is defined by the overall length of the terminal block 20, and the height of the arcuate edge 94 is designed to satisfy that when the cutting process ends, the lowest portion of the cutting blade 84 does not interfere with a bottom structure in the receptacle 108.

Figure 9B:
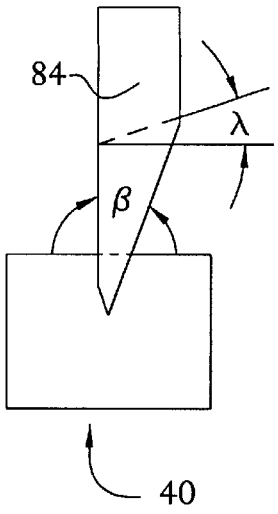
FIG. 9*b* is side, diagrammatic view illustrating the process of one of the cutting structures shown in FIGS. 3, 4, 5, 6, 7 and 8 cutting a wire, such as one of the feeder wires shown in FIGS. 1 and 2.

FIGS. 9*a* and 9*b* are diagrams which illustrate the cutting process of one of the cutting structures 84 cutting a wire 40. FIGS. 9*a* and 10*a* depict the cutting structure 84 in engagement with the wire 40 which has an insulating outer covering 64 and a central conductor 68, and has an overall diameter of $d_w$. As shown in FIGS. 9*a* and 9*b*, the cutting structure 84 is defined by an opening $v_o$ of the notch 102, the height $v_h$ of the notch 102, a cutting angle $2\alpha$, a blade angle $\beta$, and a blade protrusion angle $\lambda$.

To initiate a smooth cutting process, $v_o$ should be at least equal to the wire diameter $d_w$, so that only a small amount of the insulating outer covering 64 of the wire 40 is removed at the beginning stage of the cutting process. Preferably, for example, $v_o$ is selected to be equal to the diameter of a 22 gauge copper wire.

FIGS. 10*a* and 10*b* are free body diagrams showing the forces applied to the cutting structure 84 and wire 40, respectively, during the cutting process. FIG. 10*a* corresponds to FIG. 9*a*. As shown in FIG. 10*a*, F is the force applied to the cutting structure 84 by the terminal block 20. This force is applied to the cutting structure 84 when the upper portion 24 is brought into engagement with the platform portion 28. The force $F_1$ is the cutting force applied to the wire 40 by the cutting structure 84 as a result of bringing the upper portion 24 into engagement with the platform portion 28.

The following are force equations corresponding to forces in the "x direction" and "y direction" as one having ordinary skill in the art would understand:

$$\Sigma F_x=0: F_1 \cos \alpha - F_1 \cos \alpha = 0 \quad (1)$$

$$\Sigma F_y=0: F_1 \sin \alpha + F_1 \sin \alpha - F = 0 \quad (2)$$

From Equation (2), we have:

$$F_1 = F/2 \sin \alpha \quad (3)$$

Equation (3) implies that if $\alpha=30°$ ($2\alpha=60°$), $F_1=F$. For any angle $\alpha<30°$ ($2\alpha<60°$), the cutting force $F_1$ is>F. As such, the applied force to the cutting structure 84 will be reduced if we select $2\alpha<60°$.

Theoretically, the smaller the $2\alpha$, the lower the applied force F. In reality, if $2\alpha$ is too small, in order to satisfy $v_o \geqq d_w$, the height $v_h$ of the notch 102 will be too high and will be limited by the height of the terminal block 20. To balance these three parameters, $2\alpha$ is selected to be 45° in the preferred embodiment as shown herein.

There are also two other important angles, $\beta$ and $\lambda$, related to the cutting process. The angle $\beta$ is selected to make $v_h \geqq d_w$, so that when the cutting process ends, a bottom area 112 of the notch 102 will not touch the insulated wire 40. This is done to eliminate the applied force F increased due to the interference of the bottom 112 of the notch 102 and the insulated wire 40.

The angle $\lambda$ is designed to provide a sharp cutting edge along the width dimension of the cutting structure 84. To this end, plastic is preferably used to form the upper portion 24 and the cutting structure 84 such that a cutting edge 116 (identified in FIGS. 7 and 8) of the cutting structure 84 is not too sharp. If the cutting edge 116 is too sharp, the cutting edge 116 will deform before it is able to complete the cutting process, unlike a very sharp metal cutting edge which is typically used to achieve a pure shearing process. Therefore, a cutting edge 116 of the cutting structure 84 is designed to perform a cutting process which is a combination of compression and shearing.

Upon further engaging the upper portion 24 of the terminal block 20 with the platform portion 28, the cutting structure 84 will compress and yield the insulating outer covering 64 of the wire 40 and compress and yield, and then shear off, the central conductor 68. Generally, a degree of flow occurs in the materials of the wire 40 (the insulating outer covering 64 and the central conductor 68) during compression and yielding before the materials finally shear off. The blade protrusion angle $\lambda$ is preferably selected to be substantially equal to zero in order to maximize the strength of the cutting edge 116.

Figure 7:
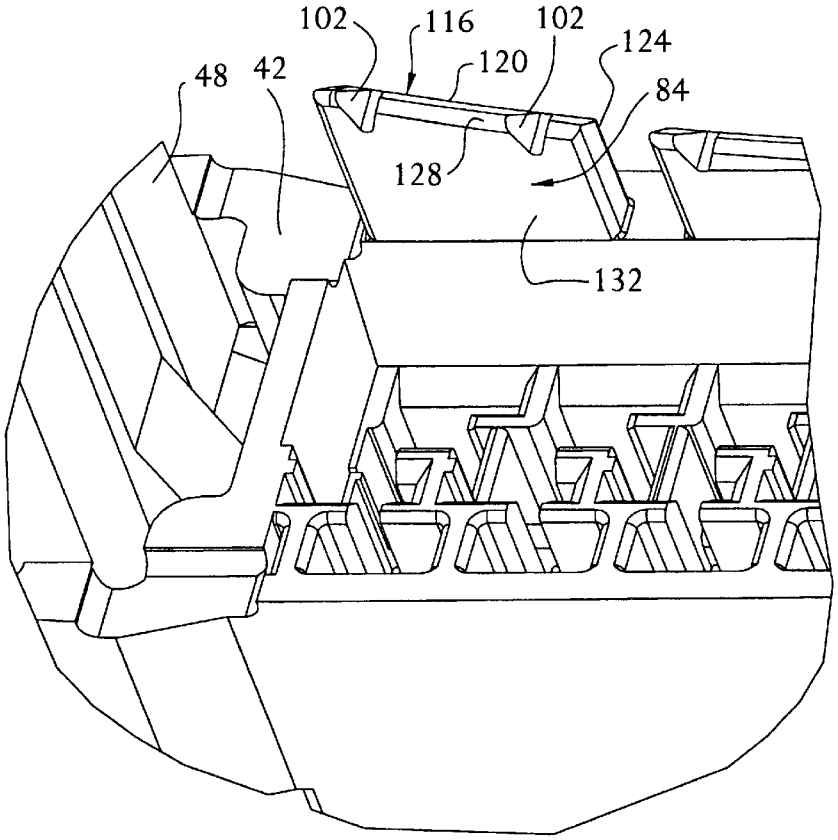
FIG. 7 is an enlarged, partial fragmentary, perspective view of the underside of the upper portion of the terminal block shown in FIG. 1, showing a pair of the cutting structures which are depicted in FIGS. 3, 4, 5 and 6, and showing, in more detail, certain features associated with the cutting structures.
Figure 8:
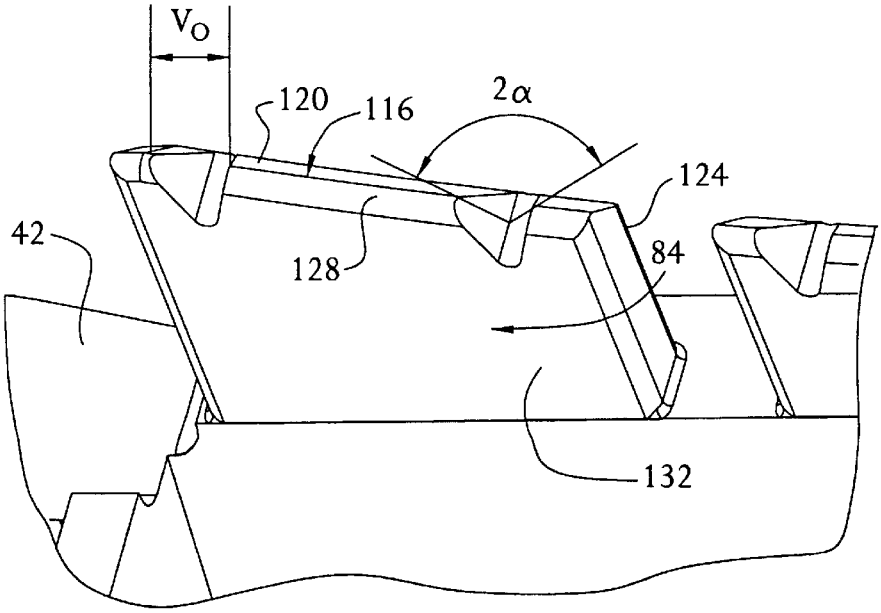
FIG. 8 is an enlarged view of one of the cutting structures shown in FIG. 7 further showing details of the cutting structure.

It can be seen in FIGS. 7 and 8 that a steep bevel 120 is provided on an outboard side 124 of the cutting structure 84 and a shallow bevel 128 is provided on an inboard side 132 of the cutting structure 84. The shallow bevel 128 on the inboard side 132 of the cutting structure 84 helps to compress and force the end of the wire 40 into the platform portion 28 of the terminal block 20. This helps to avoid a long extension of wire being drawn into the receptacle 108. The steeper bevel 120 on the outboard side 124 helps to shear off the end of the wire 40 directed towards the outboard side 124.

The geometry of the structures in the platform portion 28 also play an important role in the cutting process. The shape of the strain relief structure 52 and the slot 136 are selected to facilitate the cutting process. The channel 36 and the strain relief structure 52 are used to position the wire 40 in a desired position and retain it in the position. While the strain relief structure 52 prevents slipping of the wire towards the aperture 44, it also prevents slipping of the wire towards the slot 136. The notch 102 of the cutting structure 84 provides a complementary engaging structure with the strain relief structure 52 to securely position and retain the wire 40 while engaging the upper portion 24 with the platform portion 28. The receptacle 108 is also used to guide the cutting structure 84 to cut off the end 80 of the wire 40 in a desired manner. The slot 136 allows the cutoff portion of the wire to be removed from the terminal block 20 or to fall away from the terminal block 20.

While a preferred embodiment of the present invention is shown and described, it is envisioned that those skilled in the art may devise various modifications and equivalents without departing from the spirit and scope of the invention as set forth herein. The invention is not intended to be limited by the foregoing disclosure.

What is claimed is:

1. A cutting element configured for use in an electrical connector device for cutting two or more wires received by the electrical connector device, said cutting element comprising a member having a leading edge, said leading edge shaped for nonsimultaneously cutting multiple wires in a single cutting motion.

2. A cutting element as recited in claim 1, wherein said cutting element is aligned with a receptacle in said electrical connector device for reception therein.

3. A cutting element as recited in claim 1, wherein said leading edge is at least one of generally angled and generally non-linear.

4. A cutting element as recited in claim 1, wherein said leading edge is generally angled.

5. A cutting element as recited in claim 1, wherein said leading edge is generally non-linear.

6. A cutting element as recited in claim 1, wherein said leading edge is generally arcuate.

7. A cutting element as recited in claim 1, wherein said leading edge is beveled.

8. A cutting element as recited in claim 1, wherein said leading edge has a notch thereon.

9. A cutting element as recited in claim 8, said notch on said leading edge being formed by a plurality of angled walls.

10. A cutting element as recited in claim 9, said notch on said leading edge being formed by two angled walls defining a V-shape, said walls forming an angle of approximately forty-five degrees with respect to each other.

11. A cutting element as recited in claim 1, wherein said leading edge has a plurality of bevels thereon.

12. A cutting element as recited in claim 11, wherein said leading edge has two unequal bevels thereon.

13. A cutting element as recited in claim 11, said cutting element having an inboard side and an outboard side, said inboard side being opposite said outboard side, said inboard side being closer to a point of entry of the wire into the electrical connector device than said outboard side, each of said inboard side and said outboard side having a bevel thereon, the bevel on said outboard side being steeper than the bevel on said inboard side.

14. An arrangement of cutting elements configured for use in an electrical connector device for nonsimultaneously cutting a plurality of groups of wires received by the electrical connector device in a single cutting motion, said arrangement of cutting elements comprising a plurality of cutting elements in a side-by-side arrangement, said cutting elements configured to cut a first group of wires generally simultaneously and then subsequently cut a second group of wires generally simultaneously, all in a single cutting motion.

15. An arrangement of cutting elements as recited in claim 14, wherein said collective cutting surface is generally arcuate.

16. An arrangement of cutting elements as recited in claim 14, said collective cutting surface providing that less than all of said plurality of wires is cut at any one time.

17. An arrangement of cutting elements as recited in claim 16, said collective cutting surface providing that said plurality of wires is cut four at a time.

18. An arrangement of cutting elements as recited in claim 16, said arrangement of cutting elements being received in one or more receptacles in said electrical connector device as said cutting elements engage and cut the plurality of wires.

19. An arrangement of cutting elements as recited in claim 14, each of said leading edges having a notch thereon for engaging and cutting one of said wires.

20. An arrangement of cutting elements as recited in claim 19, said notch on said leading edge being formed by a plurality of angled walls.

21. An arrangement of cutting elements as recited in claim 20, said notch on said leading edge being formed by two angled walls defining a V-shape, said walls forming an angle of about forty-five degrees with respect to each other.

22. An arrangement of cutting elements as recited in claim 14, wherein each leading edge is beveled.

23. An arrangement of cutting elements as recited in claim 22, wherein each leading edge has two unequal bevels thereon.

24. An arrangement of cutting elements as recited in claim 23, each cutting element having an inboard side and an outboard side, said inboard side being opposite said outboard side, said inboard side being closer to a point of entry of a wire into the electrical connector device than said outboard side, each of said inboard side and said outboard side having a bevel thereon, the bevel on said outboard side being steeper than the bevel on said inboard side.

* * * * *